US006736760B1

(12) United States Patent
Lee

(10) Patent No.: US 6,736,760 B1
(45) Date of Patent: May 18, 2004

(54) FOOTPLATE FOR TREADMILL

(76) Inventor: Kuo-Lung Lee, No. 61, Mai Jou II Rd., Yi Lan City (TW)

( * ) Notice: Subject to any disclaimer, the term of this patent is extended or adjusted under 35 U.S.C. 154(b) by 0 days.

(21) Appl. No.: 10/396,783

(22) Filed: Mar. 26, 2003

(51) Int. Cl.[7] ..... A63B 22/00
(52) U.S. Cl. ..... 482/54; 482/148; 119/700
(58) Field of Search ..... 482/54, 148; 119/700

(56) References Cited

U.S. PATENT DOCUMENTS 6,117,053 A * 9/2000 Chiu ..... 482/54
D459,745 S * 7/2002 Jin ..... D21/694

* cited by examiner

*Primary Examiner*—Nicholas D. Lucchesi
*Assistant Examiner*—L Amerson
(74) *Attorney, Agent, or Firm*—Troxell Law Office PLLC

(57) ABSTRACT

A footplate for use in a treadmill is disclosed having a plurality of mounting holes in a longitudinal top channel thereof for the mounting of fastening elements to fixedly secure the footplate to one longitudinal side rail of the treadmill, keeping the planar bottom wall of the footplate closely supported on the flat top surface of the longitudinal side rail of the treadmill.

5 Claims, 8 Drawing Sheets

FOOTPLATE FOR TREADMILL

BACKGROUND AND SUMMARY OF THE INVENTION

The present invention relates generally to a treadmill and, more specifically, to a footplate for use in a treadmill, which is stable when installed and, has a lip that keeps the gap between the footplate and the continuous belt of the treadmill from sight.

FIG. 1 shows a footplate for use in a treadmill according to the prior art. According to this design, the footplate 5 has parallel grooves 511 in the top wall 51. This design of footplate 5 may be installed in a treadmill 7 (see FIG. 2) in either of the two ways shown in FIGS. 3 and 4. According to the mounting arrangement shown in FIG. 3, double-sided adhesive tapes 6 are fastened to the top walls 711 of transverse bars 71 of the treadmill 7 and the bottom wall 5110 of the footplate 5 corresponding to the grooves 511. This footplate mounting arrangement is not satisfactory in function because the double-sided adhesive tapes 6 become aged quickly with use. When the double-sided adhesive tapes 6 become aged, the footplate 5 may be forced out of plate by the user's legs. According to the mounting arrangement shown in FIG. 4, double-sided adhesive tapes 8 are fastened to inner surface portions 501 and 502 of the footplate 5 and the outer surface portions 710 of transverse frame bars 71 and outer surface portions 740 longitudinal side rail 74 of the treadmill 7. This footplate mounting arrangement has the similar drawback.

The present invention has been accomplished to provide a footplate for treadmill, which eliminates the aforesaid problem.

According to one aspect of the present invention, the footplate has a top channel longitudinally disposed at one lateral side, a plurality of mounting holes disposed in the top channel, and a plurality of fastening elements respectively mounted in the mounting holes and threaded into one longitudinal side rail of the treadmill to fixedly secure the footplate to the treadmill. According to another aspect of the present invention, an ornamental packing strip is covered on the top channel of the footplate to keep the fastening elements from sight. According to still another aspect of the present invention, the footplate further has a lip longitudinally disposed at one lateral side remote from the top channel. When installed in the treadmill, the lip keeps the gap between the continuous belt of the treadmill and the footplate from sight.

DETAILED DESCRIPTION OF THE INVENTION

Figure 1:
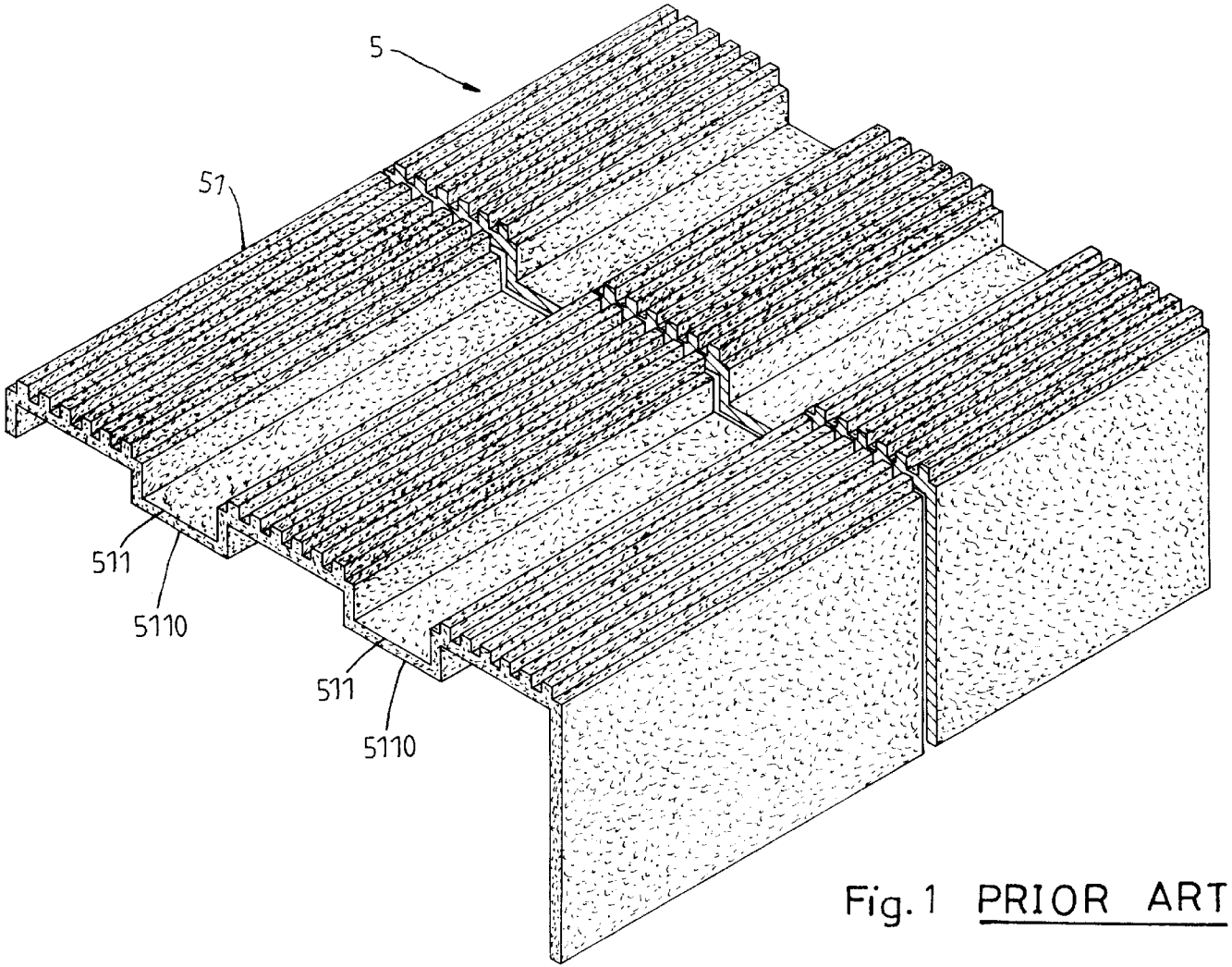
Fig. 1 PRIOR ART
FIG. 1 is a perspective view of a footplate for treadmill according to the prior art.
Figure 2:
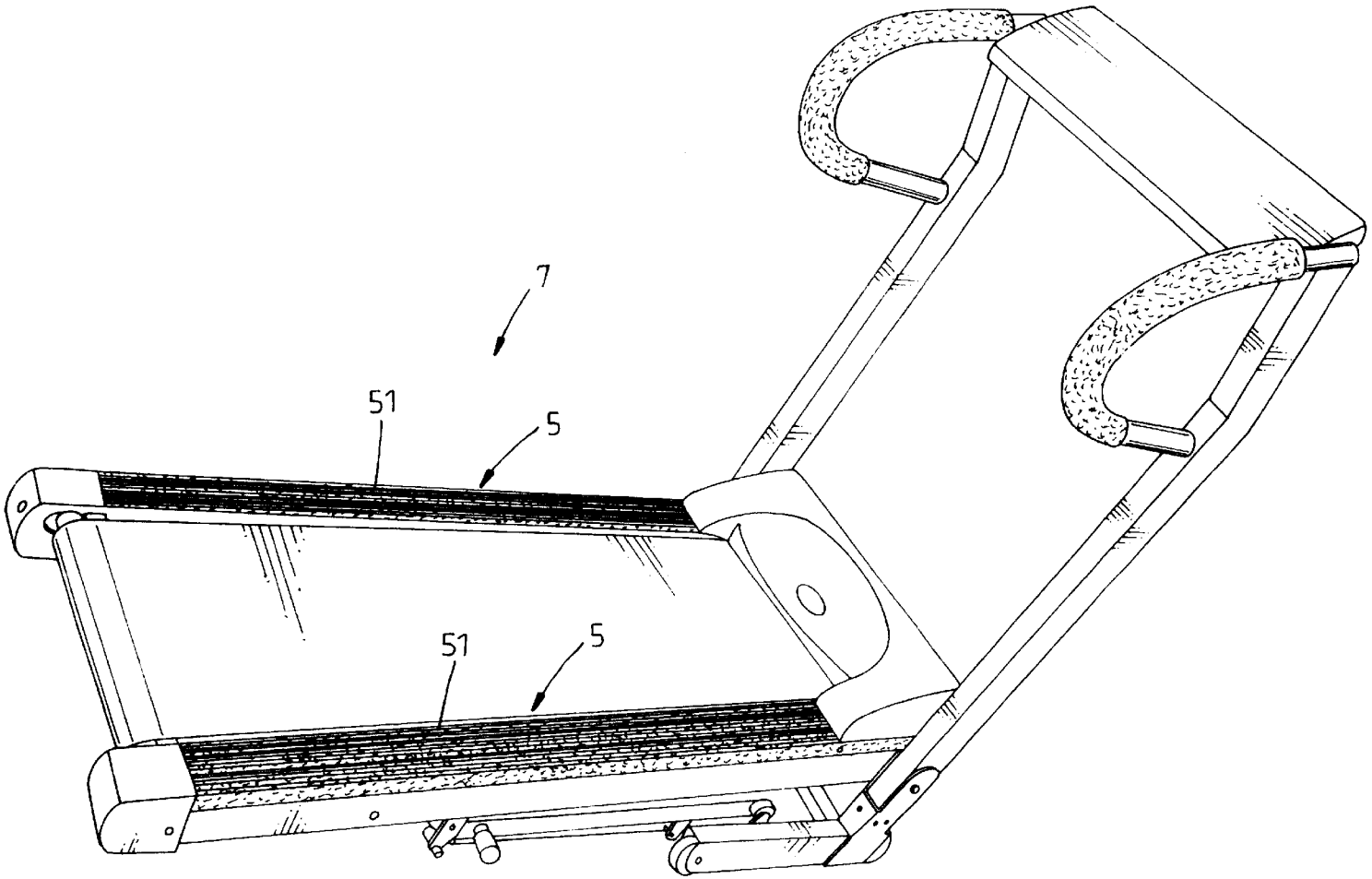
Fig. 2 PRIOR ART
FIG. 2 is an elevational view of a conventional treadmill showing the use of the prior art footplate.
Figure 3:
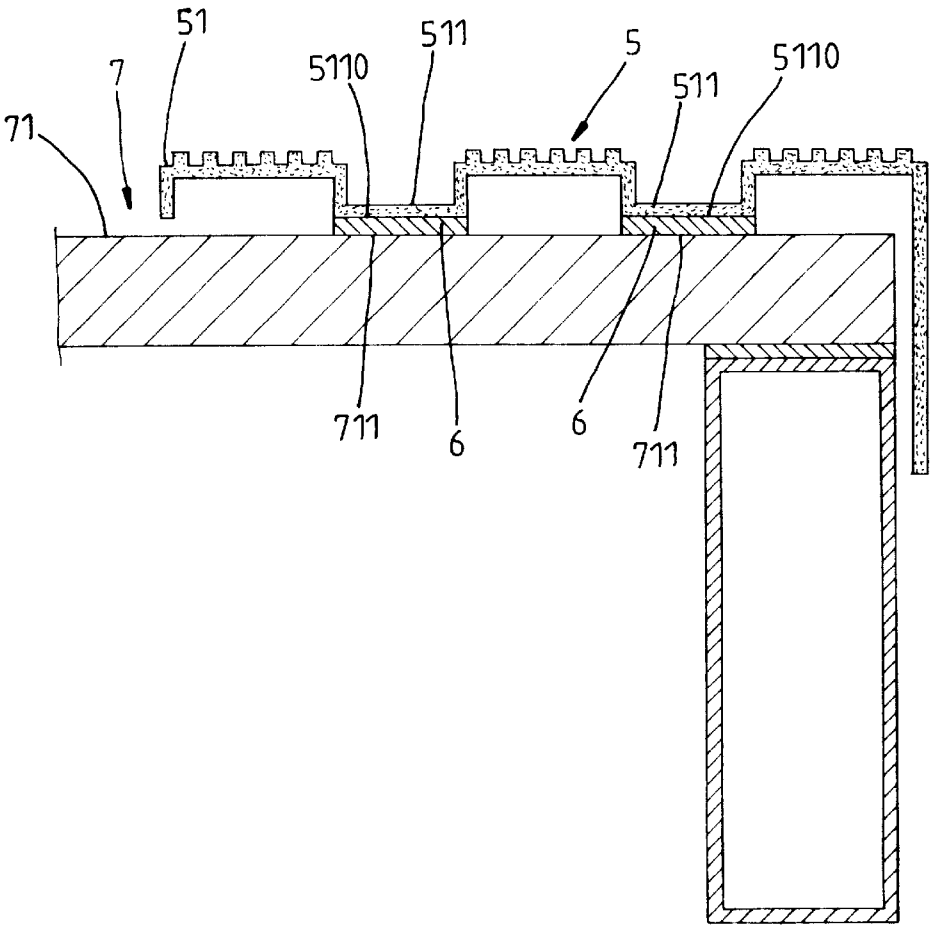
Fig. 3 PRIOR ART
FIG. 3 is a sectional view showing one installation example of the prior art footplate.
Figure 4:
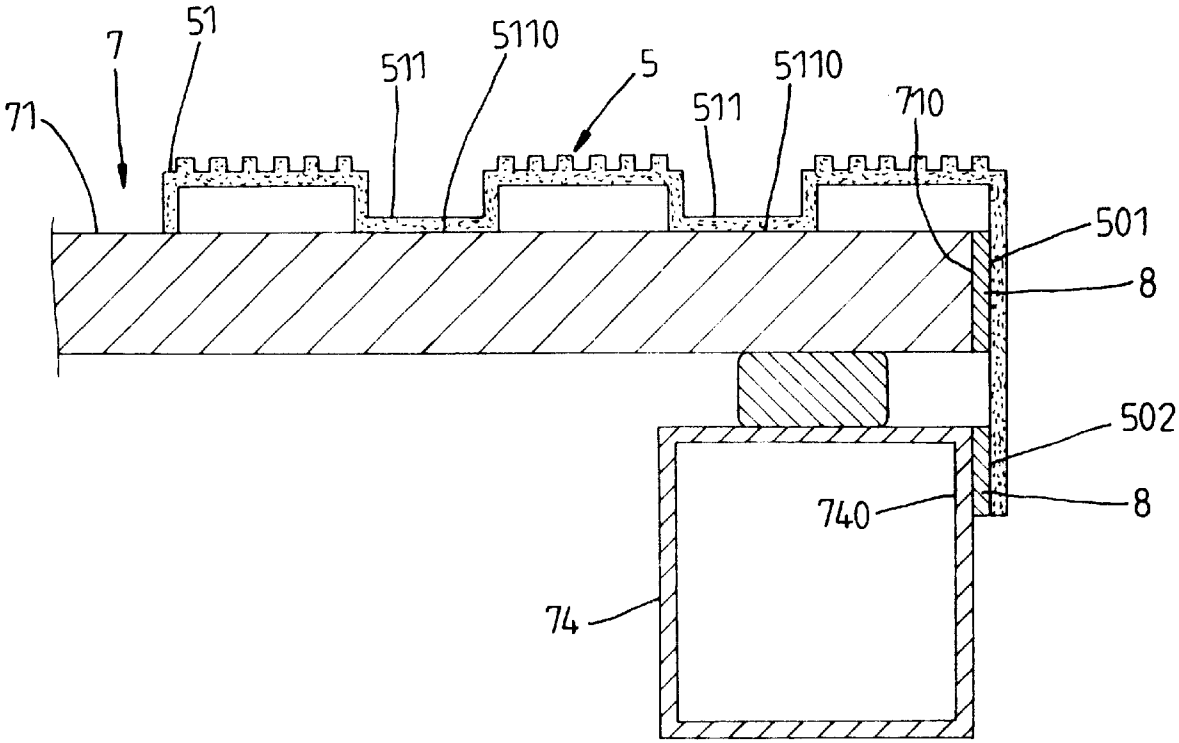
Fig. 4 PRIOR ART
FIG. 4 is a sectional view showing another installation example of the prior art footplate.
Figure 5:
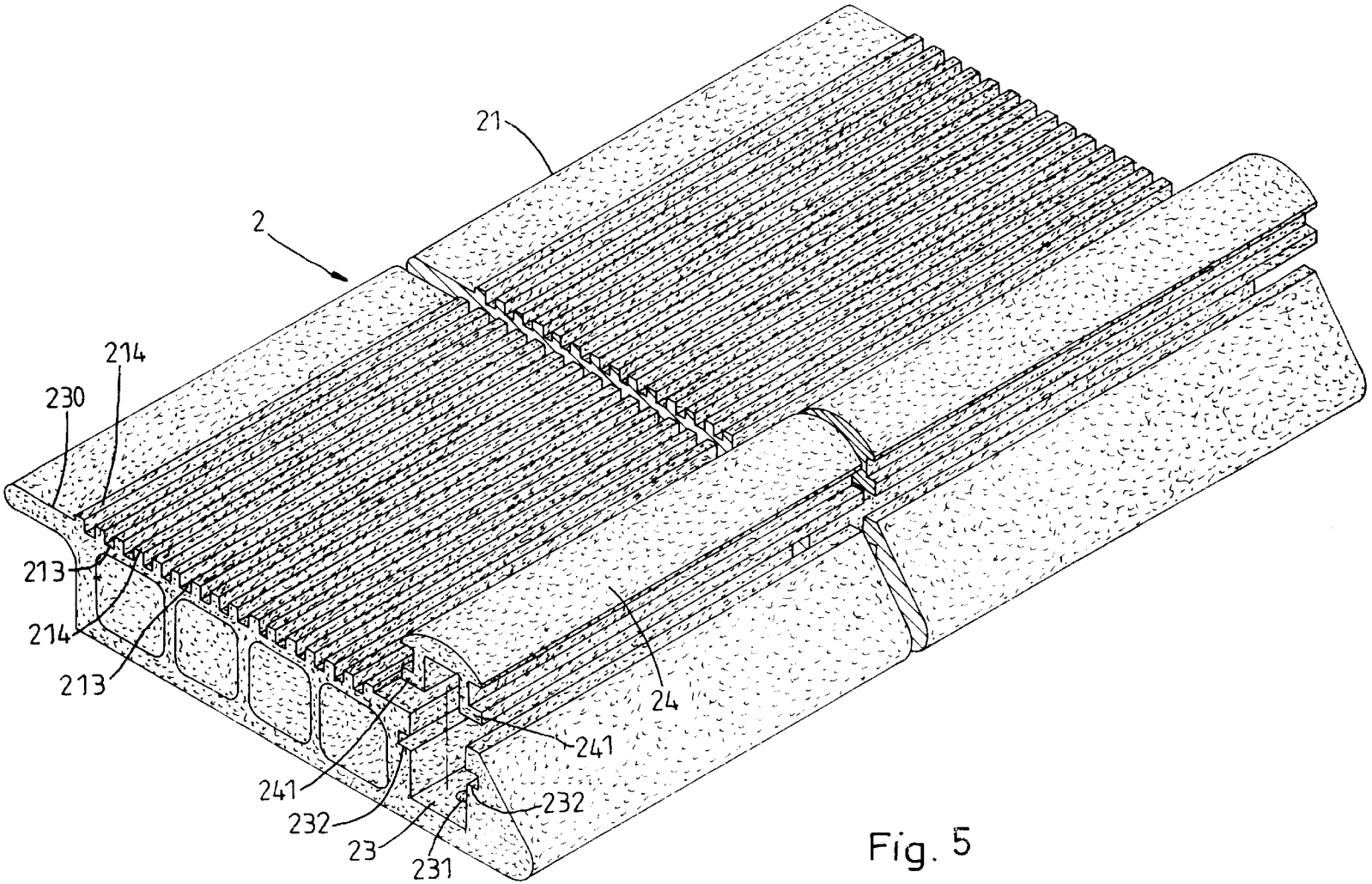
FIG. 5 is an exploded view of the preferred embodiment of the present invention.
Figure 6:
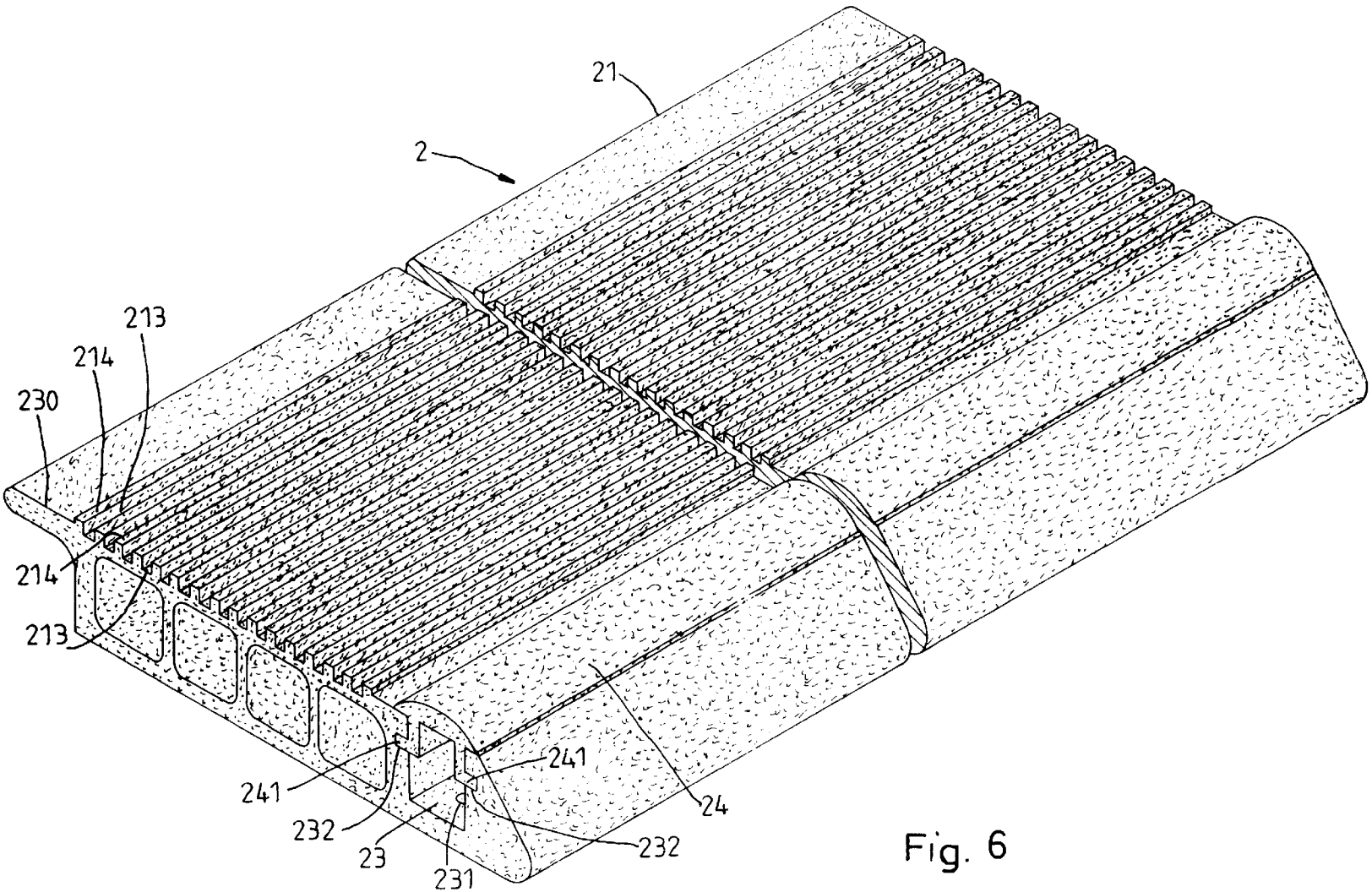
FIG. 6 is an assembly view of the preferred embodiment of the present invention.
Figure 7:
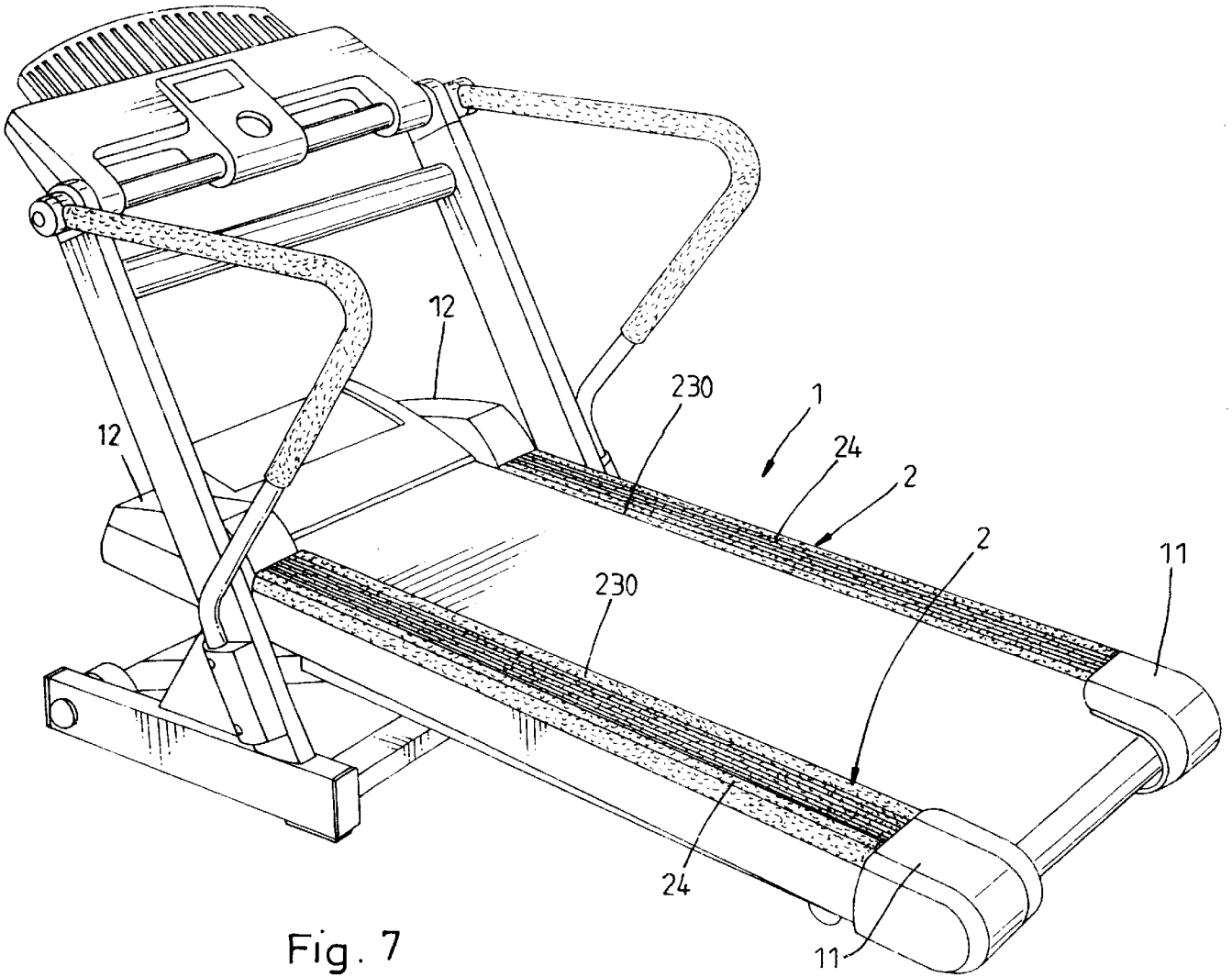
FIG. 7 is an elevational view of a treadmill showing the use of the footplate according to the present invention.
Figure 8:
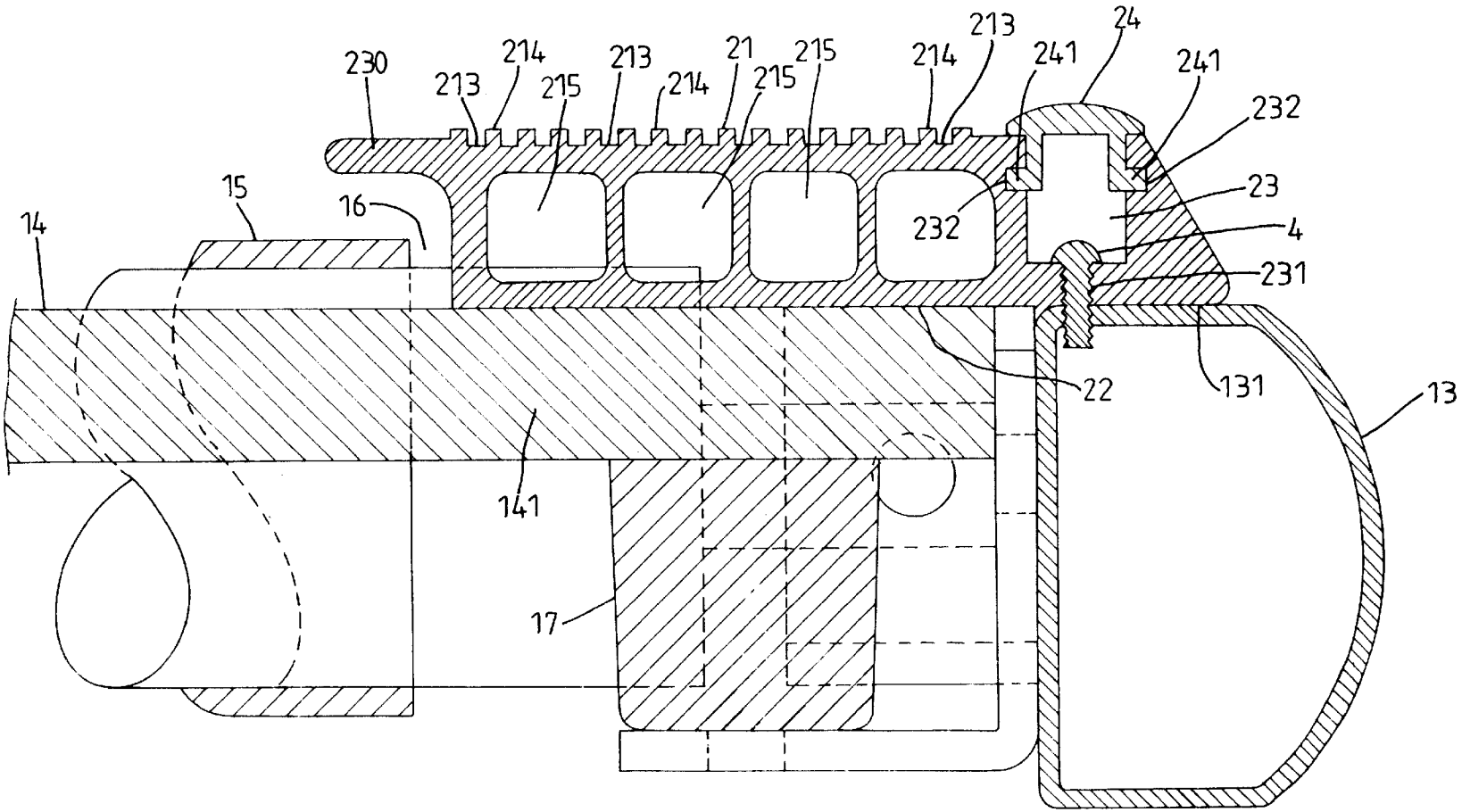
FIG. 8 is a sectional view showing the installation of the footplate in the treadbase of the treadmill according to the present invention.

Referring to FIGS. 5~8, two elongated footplates 2 are longitudinally arranged in parallel at two sides of the treadbase of a treadmill 1 above transverse frame bars 14 of the treadbase of the treadmill 1 between front end caps 11 and rear end caps 12 of the treadbase of the treadmill 1. Each elongated footplate 2 has parallel slots 215 longitudinally extended through the vertical front and rear sidewalls thereof, and a plurality of longitudinal grooves 213 and longitudinal ribs 214 extended between the vertical front and rear sidewalls and alternatively arranged in parallel on the top wall 21 thereof. The transverse frame bars 14 are supported on cushion blocks 17.

The main features of the present invention are outlined hereinafter. The footplate 2 further comprises a top channel 23 formed in the top wall 21 and extended through the vertical front and rear sidewalls in parallel to the slots 215 at one lateral side, namely, the outer lateral side (see FIG. 5), a plurality of mounting holes 231 disposed in the top channel 23 and extended through the bottom wall 22 thereof (see FIG. 8). The bottom wall 22 is a planar wall. Fastening elements, for example, screws 4 are respectively mounted in the mounting holes 231 and threaded into the corresponding longitudinal side rail 13 of the treadbase of the treadmill 1 to fixedly secure the footplate 2 to the side rail 13, keeping the planar bottom wall 22 closely supported on the flat top surface 131 of the longitudinal side rail 13 and the flat top surface 141 of each transverse frame bar 14.

Two longitudinal locating grooves 232 are provided in the top channel 23 of the footplate 2 at two sides, and adapted to hold an ornamental packing strip 24. The ornamental packing strip 24 is covered on the top channel 23 at the top to keep the fastening elements 4 from sight, having two hooked portions 241 bilaterally inserted into the top channel 23 and respectively hooked in the longitudinal locating grooves 232. Further, the ornamental packing strip 24 is preferably molded from flexible plastics or rubber.

The footplate 2 further comprises a lip 230 extended along the length at one lateral side, namely, the inner lateral side. When the footplate 2 installed in the treadmill 1, the lip 230 is suspended above the continuous belt 15 of the treadbase of the treadmill 1. Therefore, the gap 16 between the continuous belt 15 of the treadmill 1 and the footplate 2 is kept from sight by the lip 230.

What is claimed is:

1. A footplate installed in the treadbase of a treadmill and supported on one longitudinal side rail and transverse frame bars of the treadbase of the treadmill near one side of the continuous belt of the treadbase of the treadmill, the footplate having a top wall, a bottom wall, a vertical front sidewall, a vertical rear sidewall, a plurality of slots longitudinally extended through said vertical front sidewall and said vertical rear sidewall, and a plurality of longitudinal grooves and longitudinal ribs extended between said vertical front sidewall and said vertical rear sidewall and alternatively arranged in parallel on said top wall, wherein the footplate is characterized by: having a top channel formed in said top wall and extended through said vertical front sidewall and said vertical rear sidewall in parallel to said slots at one lateral side, a plurality of mounting holes disposed in said top channel and extended through said bottom wall, and a plurality of fastening elements respectively mounted in said mounting holes and threaded into said longitudinal side rail of said treadbase of said treadmill.

2. The footplate as claimed in claim 1, further comprising two longitudinal locating grooves provided in said top channel at two sides, and an ornamental packing strip covered on said top channel at a top side to keep said fastening elements from sight, said ornamental packing strip having two hooked portions bilaterally inserted into said top channel and respectively hooked in said longitudinal locating grooves.

3. The footplate as claimed in claim 1, further comprising a lip longitudinally disposed at one lateral side opposite to said top channel and suspended above said continuous belt of said treadbase of said treadmill.

4. The footplate as claimed in claim 2, wherein said ornamental packing strip is molded from flexible plastics.

5. The footplate as claimed in claim 2, wherein said ornamental packing strip is molded from rubber.

* * * * *